US009949522B2

(12) United States Patent
Ketterer et al.

(10) Patent No.: US 9,949,522 B2
(45) Date of Patent: Apr. 24, 2018

(54) SUSPENSION CONNECTION ARRANGEMENT FOR A SUSPENSION SYSTEM OF A SAFETY HELMET

(71) Applicant: Mine Safety Appliances Company, Cranberry, PA (US)

(72) Inventors: Kevin R. Ketterer, Portersville, PA (US); John F. Rihn, Glenshaw, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 166 days.

(21) Appl. No.: 14/138,979

(22) Filed: Dec. 23, 2013

(65) Prior Publication Data

US 2015/0059066 A1 Mar. 5, 2015

Related U.S. Application Data

(60) Provisional application No. 61/872,050, filed on Aug. 30, 2013.

(51) Int. Cl.

| | |
|---|---|
| ***A42B 3/08*** | (2006.01) |
| ***A42B 3/14*** | (2006.01) |
| ***A42B 3/32*** | (2006.01) |

(52) U.S. Cl.

CPC ..... *A42B 3/085* (2013.01); *A42B 3/14* (2013.01); *A42B 3/145* (2013.01); *A42B 3/147* (2013.01); *A42B 3/324* (2013.01)

(58) Field of Classification Search

CPC ..... A42B 3/00; A42B 3/125; A42B 3/127; A42B 3/145; A42B 3/064; A42B 3/04;

(Continued)

(56) References Cited

U.S. PATENT DOCUMENTS 1,199,629 A * 9/1916 Stocks ..... A42B 3/145 2/411
1,423,590 A * 7/1922 Zimmerman ..... A44B 1/32 24/669

(Continued)

FOREIGN PATENT DOCUMENTS

EP 1097649 A1 5/2001
GB 998695 A 7/1965

(Continued)

*Primary Examiner* — Katherine Moran
*Assistant Examiner* — James Heracklis
(74) *Attorney, Agent, or Firm* — The Webb Law Firm

(57) ABSTRACT

A suspension connection arrangement for a suspension system for a safety helmet, the suspension system including at least one strap connected to at least one tab, which is attachable between a headband arrangement and at least one headband slot positioned on an internal surface of the safety helmet. The suspension connection arrangement includes: at least one projection member extending from the at least one tab; and at least one keyhole connected to at least one slot, both extending at least partially through a headband member, wherein the at least one keyhole is configured to at least partially receive the at least one projection member therethrough, such that the at least one projection member is configured to slide along the at least one slot, thereby removably attaching the at least one tab to the headband member. A suspension system and a safety helmet are also disclosed.

18 Claims, 11 Drawing Sheets

(58) Field of Classification Search
CPC .. A42B 3/08; A42B 3/14; A42B 3/147; A42B 3/12; A42B 3/406; A42B 3/10; Y10T 24/45796; Y10T 24/45812
USPC .... 2/410, 414, 418, 416, 417, 420, 419, 6.6; 24/666, 669
See application file for complete search history.

(56) References Cited

U.S. PATENT DOCUMENTS 2,437,748 A * 3/1948 Malcom ..... A42B 3/145 2/183
2,438,409 A * 3/1948 Malcom ..... A42B 3/145 2/8.1
2,866,246 A * 12/1958 Waldes ..... A44B 13/0017 24/669
3,213,506 A * 10/1965 Fernberg ..... B60R 13/0206 24/289
3,221,340 A * 12/1965 Joffe ..... A42B 3/14 2/417
3,383,705 A * 5/1968 Raschke ..... A42B 3/14 2/181.4
3,387,304 A * 6/1968 Simpson ..... A42B 3/14 2/419
3,388,405 A * 6/1968 Simpson ..... A42B 3/142 2/418
3,455,528 A * 7/1969 Meyer ..... F16L 3/13 24/339
3,633,214 A * 1/1972 Newcomb ..... A42B 3/14 2/418
4,055,860 A * 11/1977 King ..... A42B 3/14 2/416
4,263,679 A * 4/1981 Erlendson ..... A42B 3/142 2/420
4,419,794 A * 12/1983 Horton, Jr. ..... A45F 5/02 224/197
4,463,456 A * 8/1984 Hanson ..... A42B 3/14 2/416
4,551,891 A * 11/1985 Kornylo ..... F16B 5/0642 24/669
4,888,831 A * 12/1989 Oleson ..... A42B 3/145 2/420
4,912,778 A * 4/1990 Daniels ..... A42B 3/10 2/416
4,932,105 A * 6/1990 Muller ..... B60N 2/466 24/297
D316,164 S * 4/1991 Furthbauer ..... D2/892
5,054,170 A * 10/1991 Otrusina ..... A45F 5/02 224/197
5,373,588 A * 12/1994 Hede ..... A42B 3/145 2/418
5,485,658 A * 1/1996 Fildan ..... A41F 1/006 24/614
5,572,749 A * 11/1996 Ogden ..... A42B 3/14 2/410
5,619,754 A * 4/1997 Thurwanger ..... A42B 3/085 2/416
5,669,118 A * 9/1997 Frano ..... A44B 11/04 24/198
5,845,341 A * 12/1998 Barthold ..... A42B 3/04 2/10
5,898,949 A * 5/1999 Barthold ..... A42B 3/14 2/411
5,950,245 A * 9/1999 Binduga ..... A42B 3/145 2/183
6,032,297 A * 3/2000 Barthold ..... A42B 3/10 2/416
6,081,931 A * 7/2000 Burns ..... A42B 3/14 2/411
6,219,851 B1 * 4/2001 Fang ..... A42B 3/145 2/418
D468,062 S * 12/2002 Santiago ..... D29/103
D484,436 S * 12/2003 Landry ..... D11/200
6,708,376 B1 * 3/2004 Landry ..... A42B 3/145 2/418
D501,956 S * 2/2005 Grepper ..... D29/122
6,862,747 B2 * 3/2005 Oleson ..... A42B 3/14 2/416
D508,659 S * 8/2005 Fang ..... D11/200
D508,871 S * 8/2005 Fang ..... D11/200
6,964,066 B2 * 11/2005 Tucker ..... A42B 3/12 2/414
6,966,074 B2 * 11/2005 Huh ..... A42B 3/14 2/181.4
7,000,262 B2 * 2/2006 Bielefeld ..... A42B 3/145 2/418
7,213,271 B1 * 5/2007 Bielefeld ..... A42B 3/14 2/181
7,707,695 B2 * 5/2010 Dubois ..... 24/68 B
8,225,419 B2 * 7/2012 Hersick ..... A42B 3/12 2/2.5
8,296,868 B2 * 10/2012 Belanger ..... A42B 3/324 2/414
8,387,162 B2 * 3/2013 Huh ..... A42B 3/14 2/424
8,584,265 B2 * 11/2013 Lilenthal ..... A42B 3/14 2/417
8,661,570 B2 * 3/2014 Huh ..... A42B 3/14 2/418
D710,545 S * 8/2014 Wu ..... D29/102
D710,546 S * 8/2014 Wu ..... D29/102
9,307,802 B2 * 4/2016 Hall ..... A42B 3/142
2002/0116749 A1 * 8/2002 Bielefeld ..... A42B 3/14 2/416
2008/0109947 A1 * 5/2008 Dubois ..... A42B 3/145 2/414
2009/0222978 A1 * 9/2009 Fang ..... A42B 3/085 2/421
2009/0293180 A1 * 12/2009 Grau ..... A42B 3/145 2/417
2010/0050325 A1 * 3/2010 Wang-Lee ..... A42B 3/145 2/418
2010/0229286 A1 * 9/2010 Ahlgren ..... A42B 3/142 2/416
2013/0205477 A1 * 8/2013 Pfanner ..... A42B 3/14 2/416
2015/0059066 A1 * 3/2015 Ketterer ..... A42B 3/085 2/418

FOREIGN PATENT DOCUMENTS

GB 2098459 A * 11/1982 ..... A42B 3/14
WO 2004010808 A1 2/2004
WO WO 2008033189 A2 * 3/2008 ..... A42B 3/12

* cited by examiner

SUSPENSION CONNECTION ARRANGEMENT FOR A SUSPENSION SYSTEM OF A SAFETY HELMET

CROSS REFERENCE TO RELATED APPLICATIONS

This application claims benefit of priority from U.S. Provisional Patent Application No. 61/872,050, filed Aug. 30, 2013, which is incorporated herein by reference in its entirety.

BACKGROUND OF THE INVENTION

Field of the Invention

The present invention relates generally to safety helmets for use in a variety of applications where head protection is desired, and in particular to a suspension connection arrangement and a suspension system used in connection with such a safety helmet.

Description of the Related Art

As is known in the art, a variety of activities, workplace functions, and emergency situations require additional safety measures and systems. In particular, such activities, functions, and situations include, without limitation, industrial or manufacturing activities, construction activities, activities that pose a potential risk to the person or persons involved, rescue situations, and the like. Providing safety equipment to those involved in such activities and situations is required, and protecting the user's head is of the utmost importance. In order to provide such protection, one of the most often worn pieces of equipment is a safety helmet.

Safety helmets (also known as protective helmets) are provided in a variety of shapes and configurations. Further, in order to comfortably position and space the protective helmet body (or dome) of the safety helmet with respect to the user's head, each safety helmet is equipped with a suspension system. This suspension system normally includes: (1) a headband arrangement having a headband member that fits around the periphery of the user's head (normally just above the forehead area) and an adjustment mechanism for tightening and loosening the headband member with respect to a user's head; (2) multiple tabs, connected or connectable to the headband member, which are removably attachable in slots positioned on the inner surface of helmet body; and (3) multiple straps connected between the tabs and extending across the headband member for contact with the top of the user's head.

Even with the adjustment mechanism, many existing safety helmets, i.e., the headband arrangements used in connection with such safety helmets, could be more effectively adjustable or configurable to safely and comfortably fit a specific user's head shape or size. Still further, the assembly of the tabs and the headband arrangement is often difficult and labor intensive.

Accordingly, there is a need in the art for improved safety helmets, suspension systems, and suspension connection arrangements for use with or in such suspension systems. Further there is a need in the art to provide safety helmets (and the various components thereof) that are more easily adjustable and/or configurable to fit a variety of shapes and sized of user's head. Still further, there is a need in the art for safety helmets (and the various components thereof) that can be more efficiently and effectively assembled, such as by the user in the field or use environment.

SUMMARY OF THE INVENTION

Generally, provided is a suspension connection arrangement for a suspension system of a safety helmet that improves on the features and functions of known safety helmet systems and suspension system configurations. Preferably, provided is a suspension connection arrangement for a suspension system of a safety helmet that facilitates the adjustment and/or configuration of the headband arrangement with respect to the user's head. Preferably, provided is a suspension connection arrangement for a suspension system of a safety helmet that allows for efficient and effective assembly in the field.

In one preferred and non-limiting embodiment, provided is a suspension connection arrangement for a suspension system for a safety helmet. The suspension system includes at least one strap connected to at least one tab, which is attachable between a headband arrangement and at least one headband slot positioned on an internal surface of the safety helmet. The suspension connection arrangement includes: at least one projection member extending from the at least one tab; and at least one keyhole connected to at least one slot, both extending at least partially through a headband member, wherein the at least one keyhole is configured to at least partially receive the at least one projection member therethrough, such that the at least one projection member is configured to slide along the at least one slot, thereby removably attaching the at least one tab to the headband member.

In another preferred and non-limiting embodiment, provided is a suspension connection arrangement for a suspension system of a safety helmet, the suspension system including at least one strap connected to a plurality of tabs, which is attachable between a headband arrangement and at least one headband slot positioned on an internal surface of the safety helmet. The suspension connection arrangement includes: at least one projection member extending from each of the plurality of tabs; and a plurality of arrangements comprising a keyhole connected to a slot, both extending at least partially through a headband member, wherein the keyhole of each arrangement is configured to at least partially receive therethrough the at least one projection member of one of the plurality of tabs, such that the at least one projection member of the tab is configured to slide along the at least one slot, thereby removably attaching the tab to a specified area of the headband member, and a plurality of sets of arrangements each comprising a plurality of keyholes each connected to a slot, wherein each of the keyholes of each set of arrangements is configured to at least partially receive therethrough the at least one projection member of one of the plurality of tabs, such that the at least one projection member of the tab is configured to slide along the respective slot, thereby removably attaching the tab to a specified area of the headband member. Each of the plurality of arrangements and plurality of sets of arrangements are at least one of spaced and aligned on the headband member.

In a further preferred and non-limiting embodiment, provided is a suspension system for a safety helmet, including: a headband arrangement having a headband member; at least one strap connected to at least one tab, wherein the at least one tab is configured to be inserted at least partially into at least one headband slot positioned on an internal surface of the safety helmet; and a suspension connection arrangement, including: (i) at least one projection member extending from the at least one tab; and (ii) at least one keyhole connected to at least one slot, both extending at least partially through the headband member, wherein the at least one keyhole is configured to at least partially receive the at least one projection member therethrough, such that the at least one projection member is configured to slide along the at least one slot, thereby removably attaching the at least one tab to the headband member.

In another preferred and non-limiting embodiment, provided is a safety helmet, including a protective helmet body having an internal surface with at least one headband slot positioned thereon. The safety helmet also includes a suspension system, including: (i) a headband arrangement having a headband member; and (ii) at least one strap connected to at least one tab, wherein the at least one tab is configured to be inserted at least partially into the at least one headband slot to thereby connect the suspension system and the helmet body; and a suspension connection arrangement, including: (i) at least one projection member extending from the at least one tab; and (ii) at least one keyhole connected to at least one slot, both extending at least partially through the headband member, wherein the at least one keyhole is configured to at least partially receive the at least one projection member therethrough, such that the at least one projection member is configured to slide along the at least one slot, thereby removably attaching the at least one tab to the headband member.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
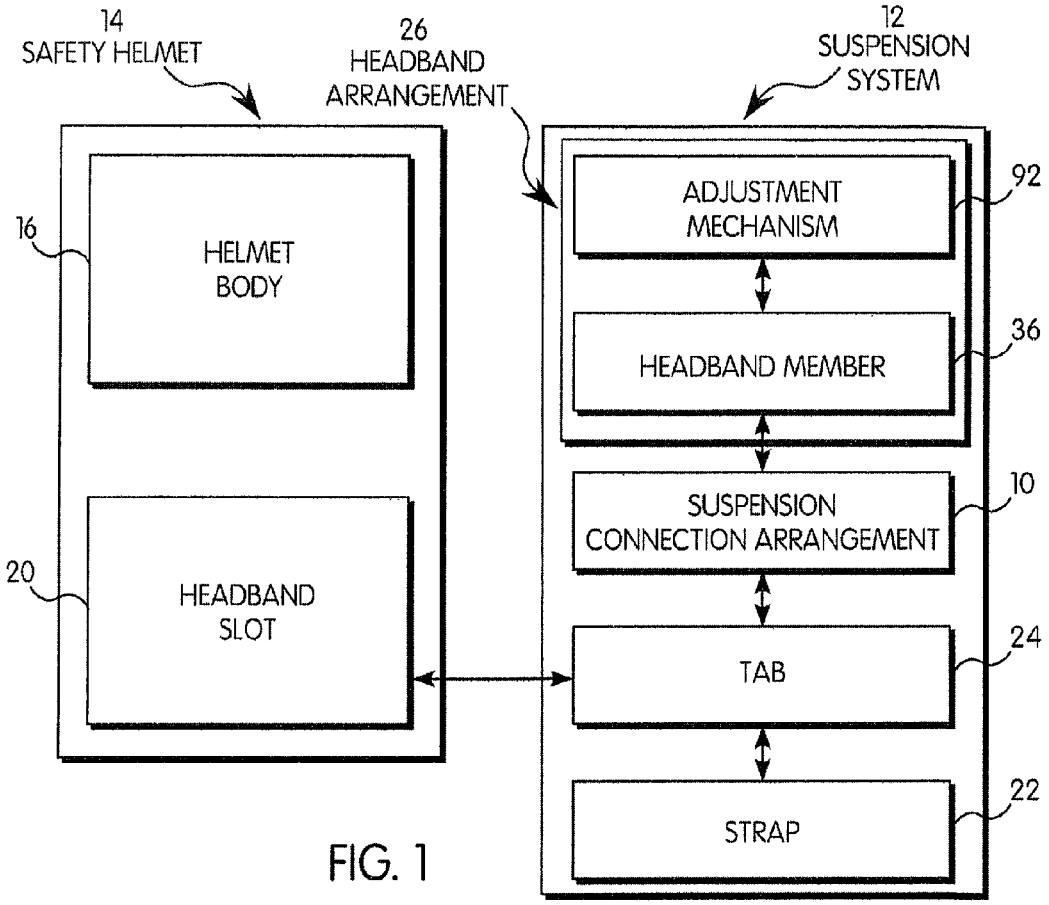
FIG. 1 is a schematic view of a suspension connection arrangement for a suspension system of a safety helmet according to the principles of the present invention.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention is directed to a suspension connection arrangement 10 for use with or as part of a suspension system 12 of a safety helmet 14. The suspension connection arrangement 10, suspension system 12, and safety helmet 14 are shown in schematic form in FIGS. 1 and 2, and in various preferred and non-limiting embodiments in FIGS. 3-12. As discussed above, and as is known, a safety helmet 14 includes a protective helmet body 16, which is typically and substantially in the shape of a dome or similar geometry. The helmet body 16, and in particular the internal surface 18 of the helmet body 16, includes at least one, and typically multiple headband slots 20. Further, the helmet body 16 is manufactured from a suitably strong and rigid material to protect the head of the user. In order to appropriately position and wear the safety helmet 14, the suspension system 12 is engaged with the helmet body 16. This suspension system 12, which includes a variety of components (as discussed hereinafter), allows the user to safely and comfortably don, adjust, and wear the safety helmet 14 in a variety of situations and environments that require protective headwear.

With continued reference to FIG. 1, the suspension system 12 includes at least one, and typically multiple straps 22 that are connected to at least one, and typically multiple tabs 24. Further, each tab 24 is attachable between a headband arrangement 26 and a respective headband slot 20 disposed on the internal surface 18 of the helmet body 16. In this manner, the suspension system 12, including the headband arrangement 26, is attachable to the safety helmet 14.

Figure 2:
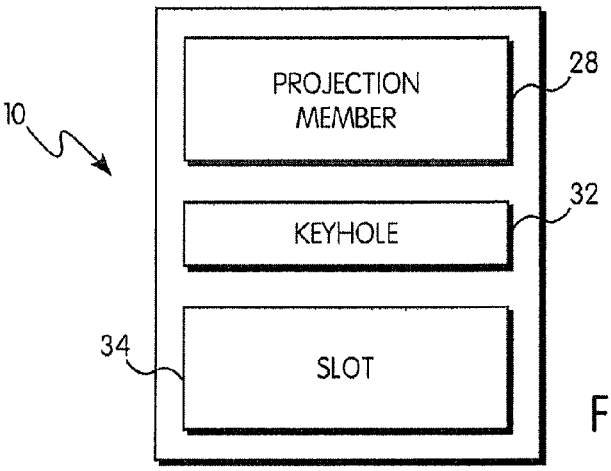
FIG. 2 is a schematic view of one embodiment of a suspension connection arrangement for a suspension system of a safety helmet according to the principles of the present invention.

As illustrated in schematic form in FIG. 2, and in one preferred and non-limiting embodiment, the suspension connection arrangement 10 includes at least one projection member 28 that extends from a surface 30 of the tab 24. In addition, the suspension connection arrangement 10 includes at least one keyhole 32 connected to at least one slot 34 (thereby creating a keyhole 32/slot 34 arrangement, where both the keyhole 32 and slot 34 extend at least partially through a headband member 36 of the headband arrangement 26. In operation, and in order to attach the headband member 36 to the tab 24 (and, thus, to the helmet body 16), the keyhole 32 is configured, sized, or shaped to at least partially receive the projection member 28 therethrough, such that the projection member 28 is capable of sliding along the slot 34. This results in a removable and adjustable attachment between the tab 24 and the headband member 36. One preferred and non-limiting embodiment of the safety helmet 14, suspension system 12, and suspension connection arrangement 10 is illustrated in a variety of assembled and disassembled forms and arrangements in FIG. 3-6.

Figure 7:
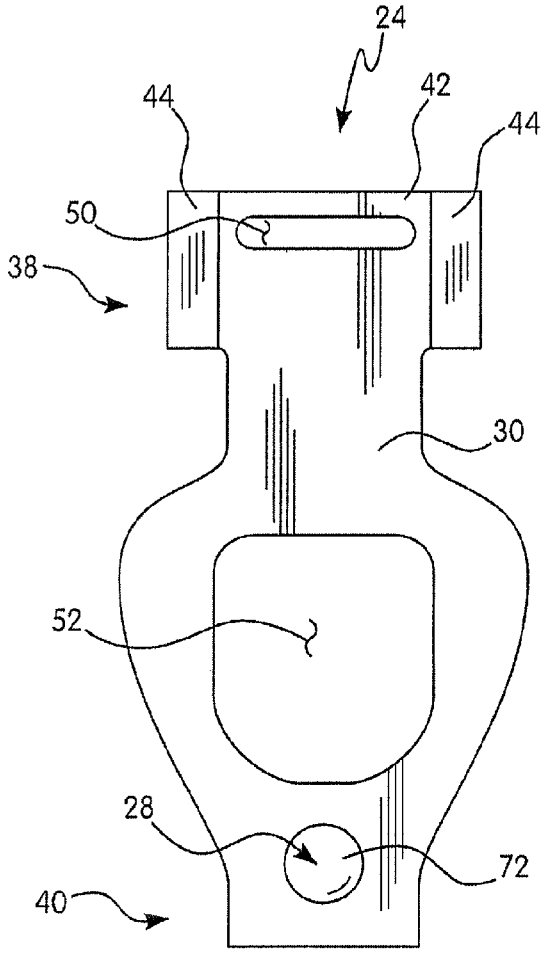
FIG. 7 is a top view of a tab of a portion of a suspension connection arrangement according to the principles of the present invention.
Figure 8:
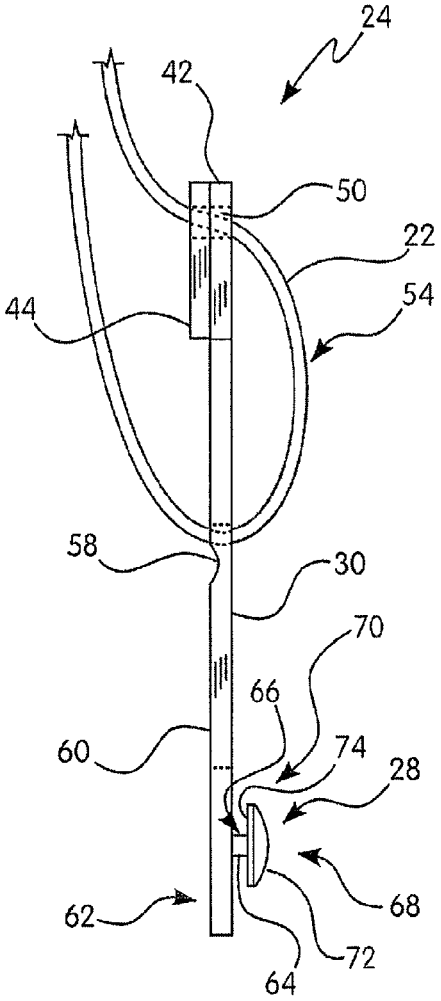
FIG. 8 is a side view of the tab with a connected strap according to FIG. 7A.
Figure 7A:
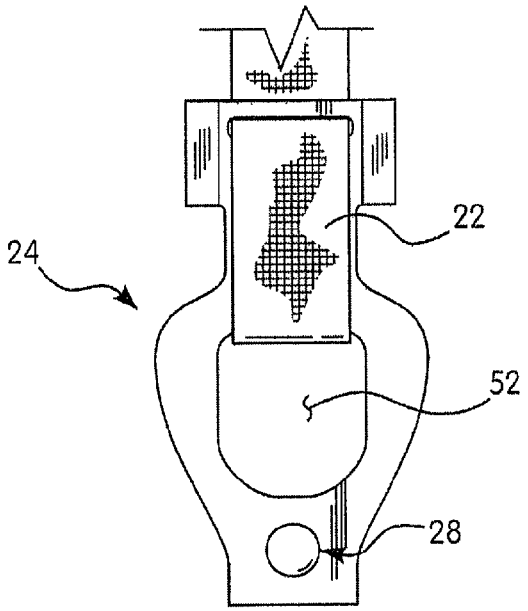
FIG. 7A is a top view of the tab according to FIG. 7 with a connected strap of a suspension connection arrangement according to the principles of the present invention.

A preferred and non-limiting embodiment and configuration of the tab 24 is illustrated in FIGS. 7 and 8, where the tab 24 of FIG. 8 further demonstrates how the strap 22 is attached thereto. With reference to FIGS. 7 and 8, and in this preferred and non-limiting embodiment, the tab 24 includes a first end 38 and a second end 40. At the first end 38 of the tab 24, there is a central portion 42 with two extending wing portions 44. Further, this first end 38 of the tab 24 is configured to be removably attachable with the headband slot 20, which includes a central slot 46 with two wing slots 48 connected thereto. See FIG. 3. In order to attach the tab 24 (and, therefore, the headband arrangement 26) to the helmet body 16, the first end 38 of the tab 24 is inserted into a respective headband slot 20, where the central portion 42 of the tab 24 is positioned in the central slot 46 of the headband slot 20, and the wing portions 44 of the first end 38 of the tab 24 are positioned in the wing slots 48 of the headband slot 20. In this manner, the tab 24 is removably attachable to the helmet body 16. In this embodiment, the first end 38 of the tab 24, a first strap orifice 50 extends through the central portion 42 of the tab 24, and, as seen in FIG. 8, this first strap orifice 50 is sized and/or shaped to allow smooth and free passage of the strap 22 therethrough.

Figure 3:
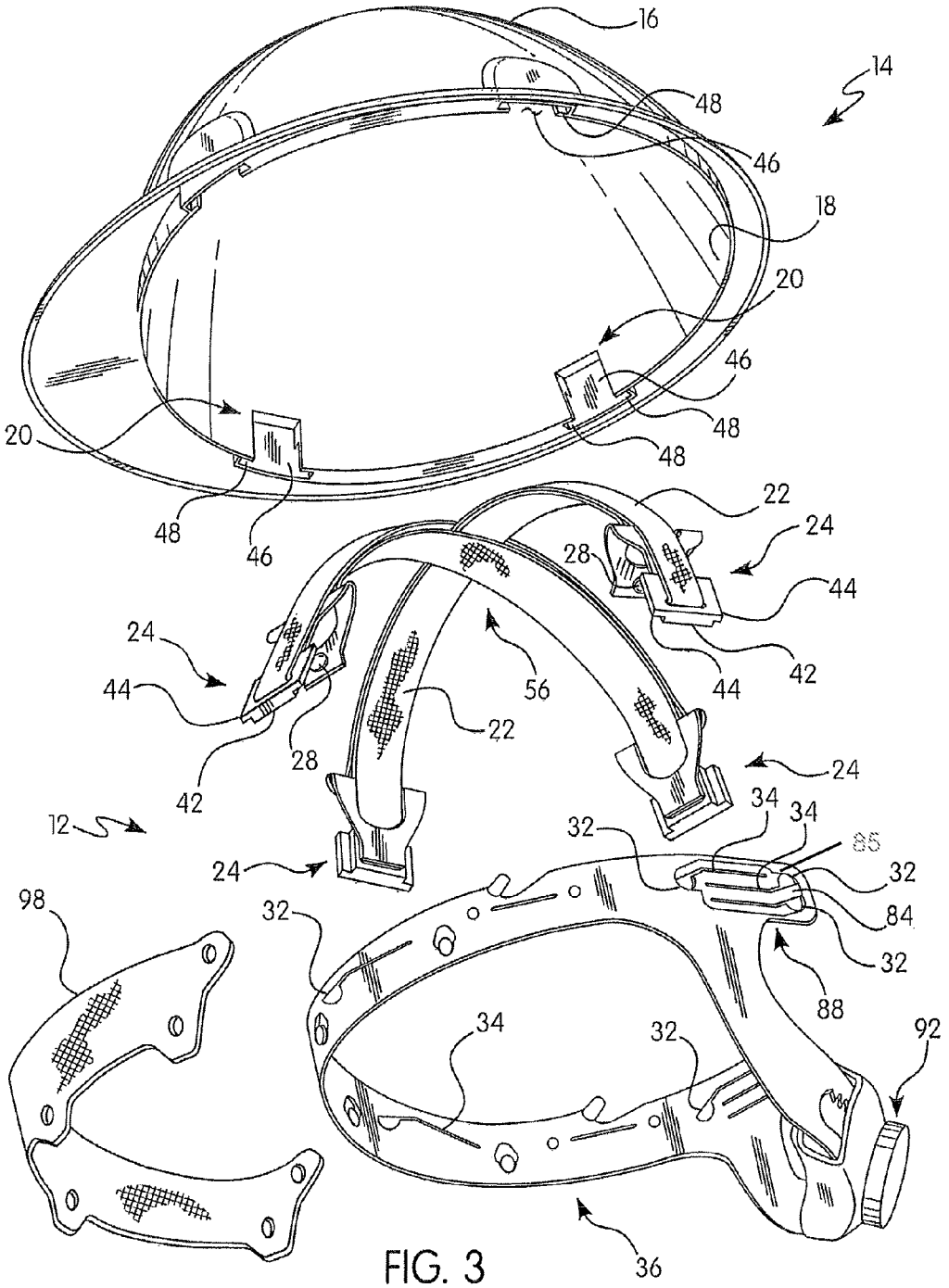
FIG. 3 is a perspective view of one preferred embodiment of a safety helmet, a suspension system for the safety helmet, and a suspension connection arrangement therefore according to the principles of the present invention.
Figure 4:
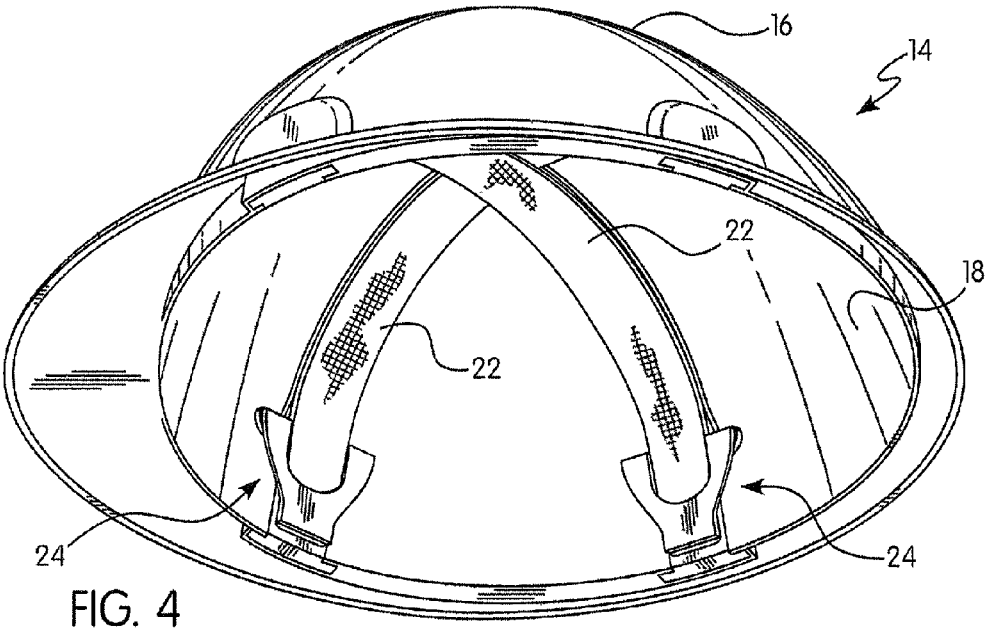
FIG. 4 is a perspective view of a partially assembled safety helmet, suspension system, and suspension connection arrangement according to FIG. 3.

With continued reference to this preferred and non-limiting embodiment of the tab 24, the second end 40 of the tab 24 includes a second strap orifice 52, which is sized and/or shaped to allow smooth and free passage of the strap 22 therethrough. Accordingly, as seen in FIG. 8, the strap 22 is inserted up through the first strap orifice 50 and down through the second strap orifice 52 to thereby make a loop 54, which connects multiple tabs 24 together. In addition, and as seen in FIG. 3, the straps 22 are arranged and connected between the tabs 24 so as to facilitate both removable attachment of the tabs 24 to the helmet body 16, as well as a substantially cross-shaped arrangement 56 for contacting the user's head and properly spacing the helmet body 16 from the user's head. Multiple straps 22 may be used in this configuration and connected or otherwise attached together to create this multi-strap cross-shaped arrangement 56.

Figure 8A:
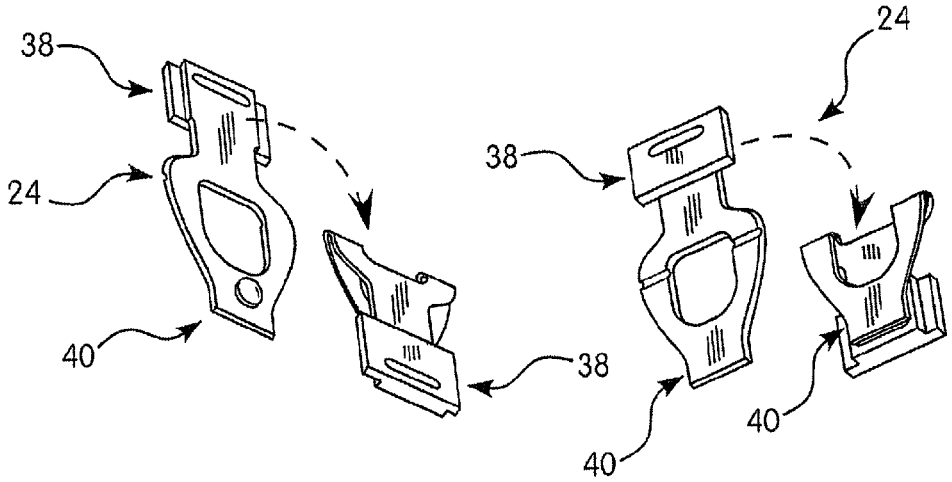
FIG. 8A is a perspective views of the tab according to FIG. 7 in folded and unfolded states.

With continued reference to FIGS. 7 and 8, the second end 40 of the tab 24 also includes a notch 58 at least partially extending across a bottom surface 60 of the tab 24. This notch 58 allows the tab 24 to be bent or otherwise folded in half to allow for the appropriate attachment of the tabs 24 to the headband slots 20. Further, the projection member 28 is positioned on or at an extension area 62 on the second end 40 of the tab 24. As discussed, it is this projection member 28 that is configured, sized, and/or shaped to be removably engaged with or connected to the keyhole 32. Additionally, as should be noted from FIGS. 3, 4, and 8A, when the tabs 24 are attached to the headband member 36, the tabs 24 are then bent along the notch 58, such that the first end 38 of the tab 24 overlaps the headband member 36 and covers the attached projection member 28. Once in the folded position, the central portion 42 and wing portions 44 of each tab 24 is inserted in a respective central slot 46 and wing slots 48 of a headband slot 20.

With continued reference to FIGS. 7 and 8, and in this preferred and non-limiting embodiment, the projection member 28 includes a stem 64 with a first end 66 of the stem 64 attached to the first (top) surface 30 of the tab 24. Further, a cap 68 extends from or is positioned on a second end 70 of the stem 64. In this embodiment, the cap 68 is in a substantially circular form (as viewed from above), and includes a domed or mushroom-shaped cross-section with a rounded upper surface 72 and a substantially flat lower surface 74.

Figure 9A:
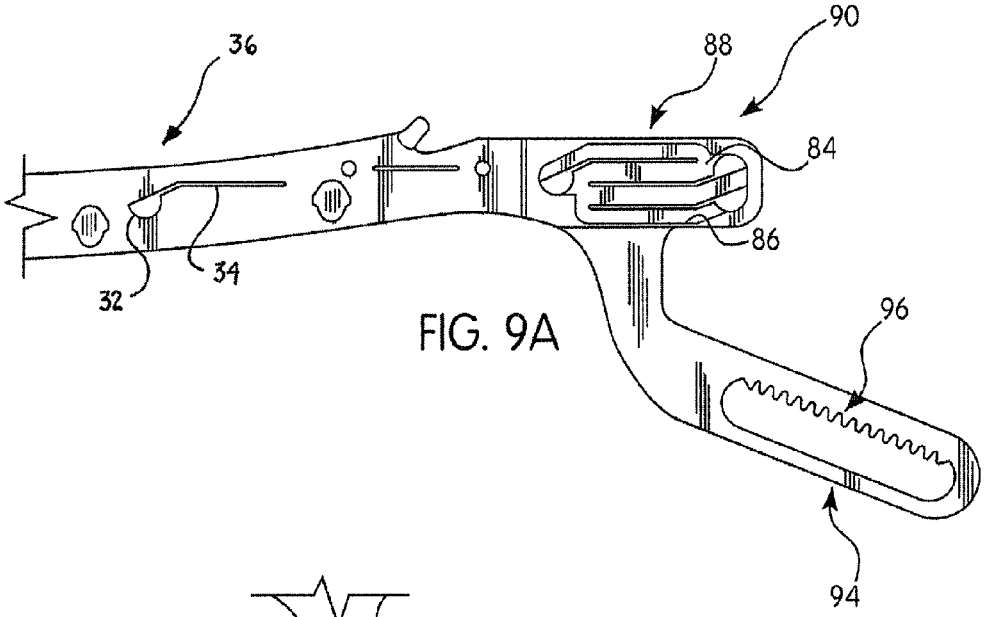
FIG. 9A is a side view of a portion of a headband member of a suspension connection arrangement according to the principles of the present invention.
Figure 9B:
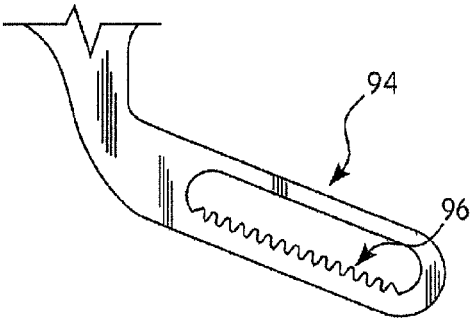
FIG. 9B is a side view of another portion of the headband member of a suspension connection arrangement according to the principles of the present invention.

As illustrated in FIGS. 9A and 9B, and as discussed above, the headband arrangement 26 includes a headband member 36. The keyholes 32 and slots 34 are arranged on the headband member 36 at specified locations. With reference to FIG. 9A, and in one preferred and non-limiting embodiment, the keyhole 32 is substantially semi-circular in shape, and the slot 34 extends from a lower portion 76 of the keyhole 32. Further, and as is seen, the keyhole 32 of this embodiment is shaped to receive the projection member 28 through an angled urging force of the cap 68 through the keyhole 32. In particular, the projection member 28, e.g., the stem 64 and cap 68, is urged through the keyhole 32 such that the flat lower surface 74 of the cap 68 is configured to contact an outer surface 78 of the headband member 36, particularly an area of the outer surface 78 surrounding or adjacent the keyhole 32 and/or slot 34.

With continued reference to FIG. 9A, and in this preferred and non-limiting embodiment, the stem 64 of the projection member 28 is sized and/or shaped to move within and along the slot 34, such that the slot 34 is captured between the flat lower surface 74 of the cap 68 and the first surface 30 of the tab 24. This allows for lateral adjustment of the tab 24 along the headband member 36. In another preferred and non-limiting embodiment, the slot 34 includes an angle portion 80, where the stem 64 of the projection member 28 is able to slide along and through this angle portion 80 to any position along a linear portion 82. This angle portion 80 helps to ensure that the projection member 28 is not inadvertently moved out of the slot 34, and potentially, the keyhole 32.

In order to further assist in positioning the projection member 28 through the keyhole 32 and into the slot 34, and in another preferred and non-limiting embodiment, at least a portion of the projection member 28 is flexible and/or bendable so that the user can angle the cap 68 through the keyhole 32 and into position where the flat lower surface 74 contacts the outer surface 78 of the headband member 36. In addition, and in order to further facilitate this action, all or a portion of the headband member 36 may also be formed of a flexible and/or bendable material. By using these flexible and/or bendable materials for the headband member 36 and the projection member 28, the process of connecting and disconnecting the projection member 28 and headband member 36 is more easily accomplished.

Figure 10:
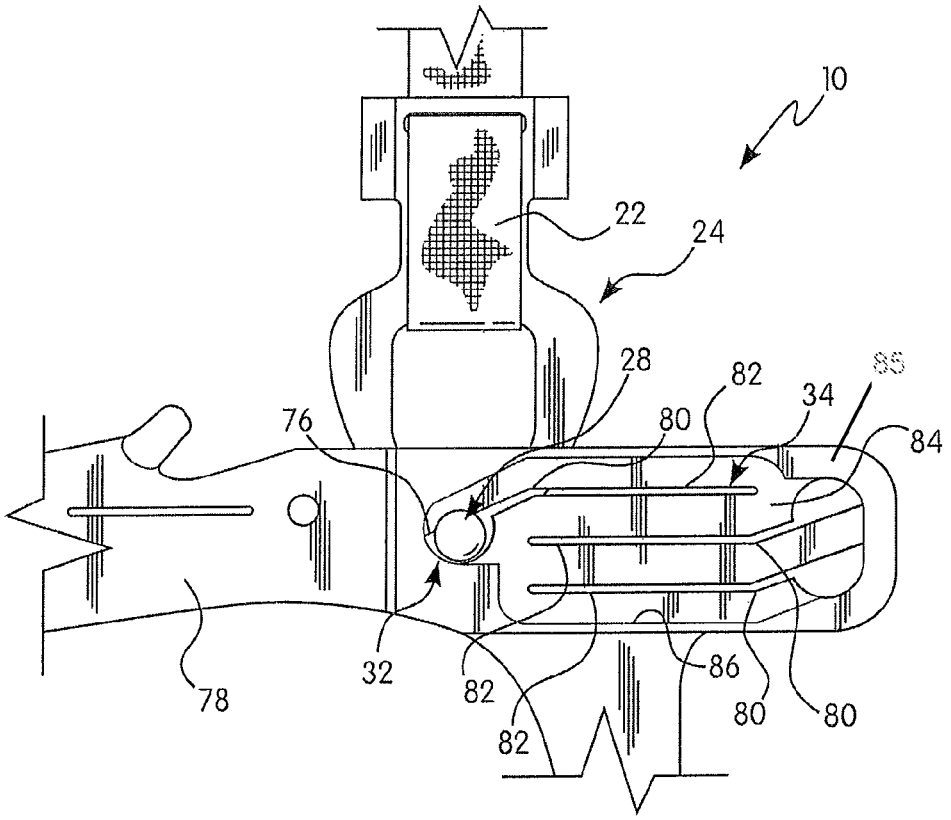
FIG. 10 is a perspective view of a suspension connection arrangement at an initial engagement step and according to the principles of the present invention.

With further reference to FIGS. 9A and 10, and in a further preferred and non-limiting embodiment, at least a portion of the keyhole 32 and/or slot 34 is positioned within a recessed area 84 of the headband member 36, such that this recessed area 84 is provided on the outer surface 78 of the headband member 36 and is recessed inwardly from the outer surface 78 in a thickness direction of the headband member 36. By using this recessed area 84, which, in one preferred and non-limiting embodiment, is shaped to allow both the keyhole 32 and the slot 34 to be recessed from the remaining portions of the outer surface 78 of the headband member 36, the cap 68 of the projection member 28 is prevented from extending substantially beyond this recessed area 84 when the projection member 28 is engaged with the keyhole 32 and/or slot 34. Further, by positioning the keyhole 32 and slot 34 in this recessed area 84, at least a portion of a wall 86 that defines the recessed area 84 can be used in guiding the cap 68 through the keyhole 32 and/or along the slot 34.

Still further, and in another preferred and non-limiting embodiment, the recessed area 84 is defined by the thickened areas 85 that surround this area 84. Accordingly, the recessed area 84, along with the resulting thickened area 85 or portion, assists in preventing the extension area 62 on the second end 40 of the tab 24 from being urged or pressed against the user's head while wearing the safety helmet 14. In particular, this arrangement allows the rounded upper surface 72 of the projection member 28 to be at least partially recessed or positioned within the recessed area 84, thereby reducing any resulting urging or pressing forces when the headband member 36 is attached within the safety helmet 14. In addition, these thickened areas 85 or portions provide stiffening characteristics or structural rigidity to the headband member 36 leading additional and beneficial durability.

In a further preferred and non-limiting embodiment, and as illustrated in FIGS. 9A and 10, one or more sets 88 of multiple keyholes 32 and slots 34 are positioned or aligned in various areas on the headband member 36. For example, it may be desirable to facilitate adjustment of the straps 22 and tabs 24 up and down with respect to the user's head, which consequently adjusts the position of the safety helmet 14 with respect to the user. Accordingly, and when four tabs 24 are used, a set 88 of keyhole 32/slot 34 arrangements can be positioned at or near an end 90 of the headband member 36; preferably at both ends 90 of the headband member 36, such as to allow adjustment in unison. In this preferred and non-limiting embodiment, the set 88 of keyholes 32 and slots 34 includes three keyhole 32/slot 34 arrangements positioned at or near the end 90 of the headband member 36. Further, along the length of the headband member 36, an additional two keyhole 32/slot 34 arrangements are provided, one each in two different areas of the headband member 36. This embodiment allows for the connection of four tabs 24, with two of the tabs 24 connectable to the ends 90 of the headband member 36 to use any of the three keyhole 32/slot 34 arrangements of the set 88.

Figure 11:
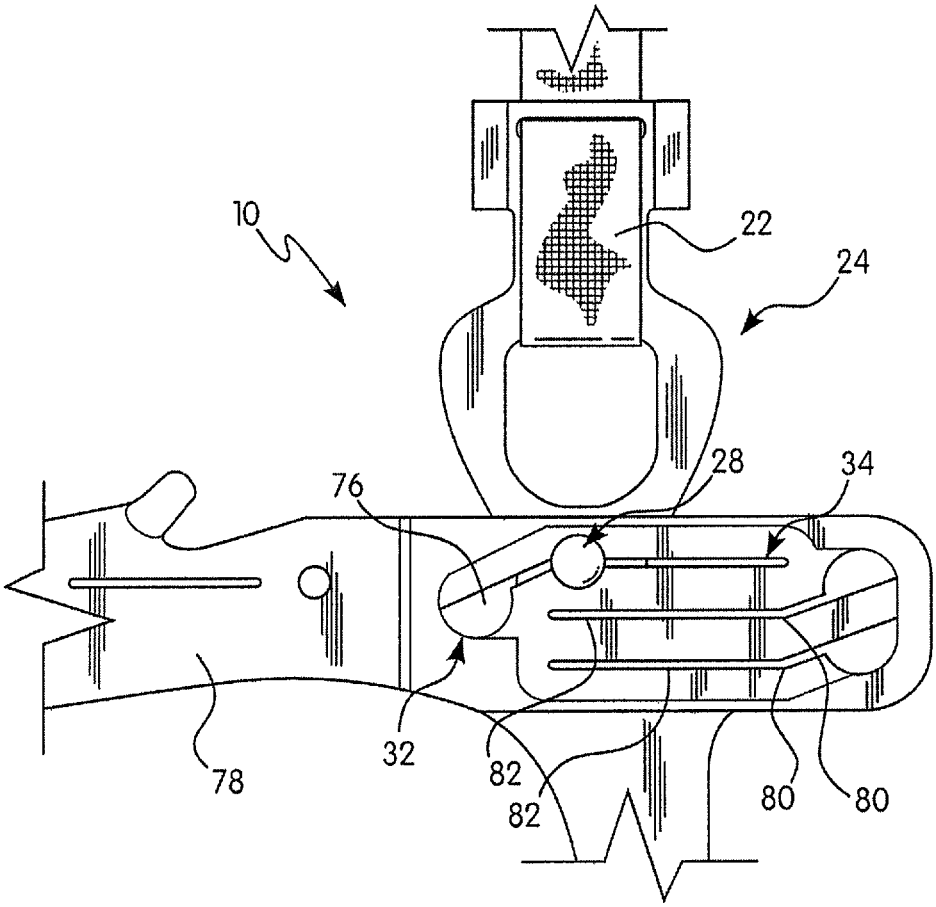
FIG. 11 is a perspective view of the suspension connection arrangement according to FIG. 10 at another engagement step.
Figure 12:
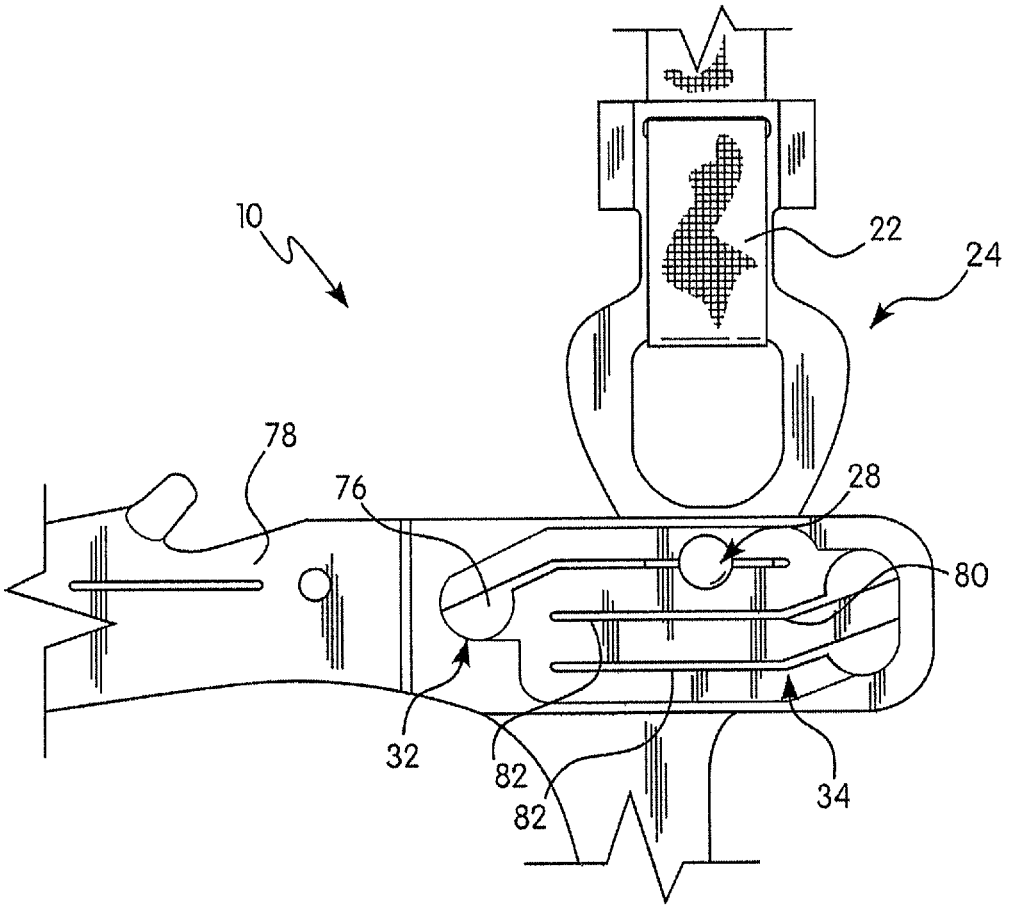
FIG. 12 is a perspective view of the suspension connection arrangement according to FIG. 10 at a further engagement step.

As discussed, this embodiment facilitates the ability of the user to adjust the fit of the headband member 36, and, thus, the suspension system 12, with respect to the helmet body 16. In order to effect this adjustment, the user may simply remove the projection member 28 from one of the keyhole 32/slot 34 arrangements and insert it into another keyhole 32/slot 34 arrangement. As discussed, this is typically done in unison at both ends 90 of the headband member 36. The connection of one of the projection members 28 to one of the keyhole 32/slot 34 arrangements in various stages of connections is shown in FIGS. 10-12 (but, prior to folding the tab 24 for insertion in the headband slot 20. As seen, the user urges or moves the projection member 28 through the keyhole 32 (FIG. 10), and moves the projection member 28 towards the angle portion 80 of the slot 34 (FIG. 11), and, finally, along the linear portion 82 of the slot 34.

Figure 5:
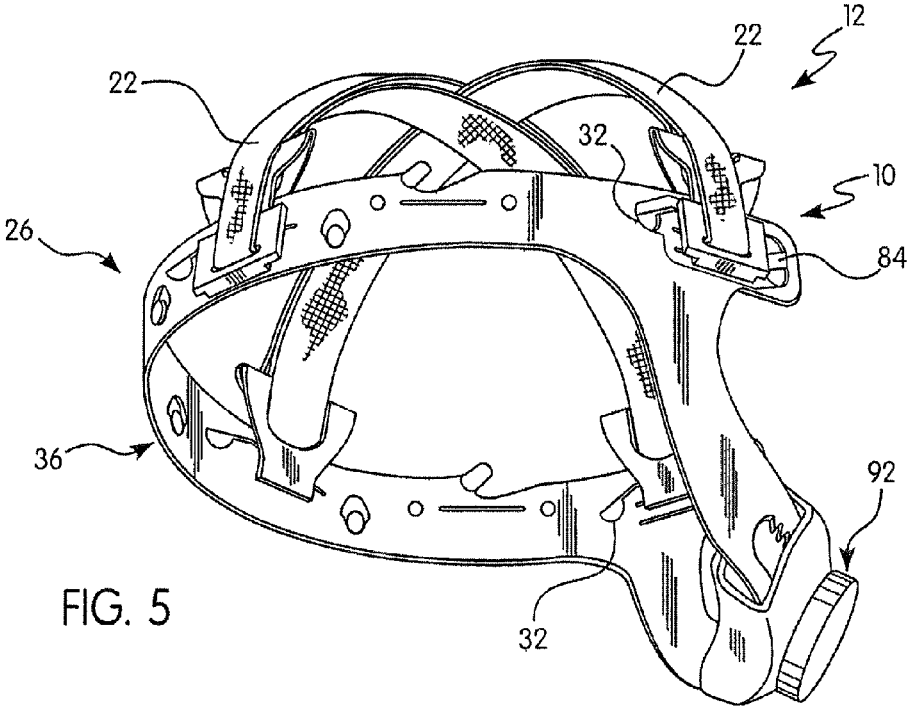
FIG. 5 is a further perspective view of a partially assembled safety helmet, suspension system, and suspension connection arrangement according to FIG. 3.
Figure 4A:
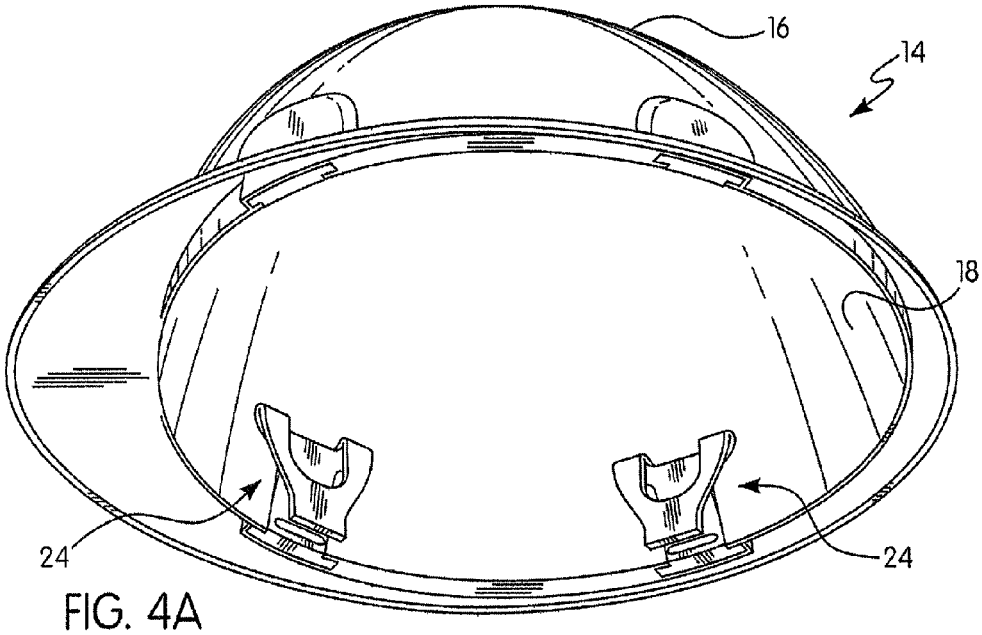
FIG. 4A is a perspective view of the partially assembled safety helmet, suspension system, and suspension connection arrangement according to FIG. 4 with the straps removed for clarity.
Figure 6A:
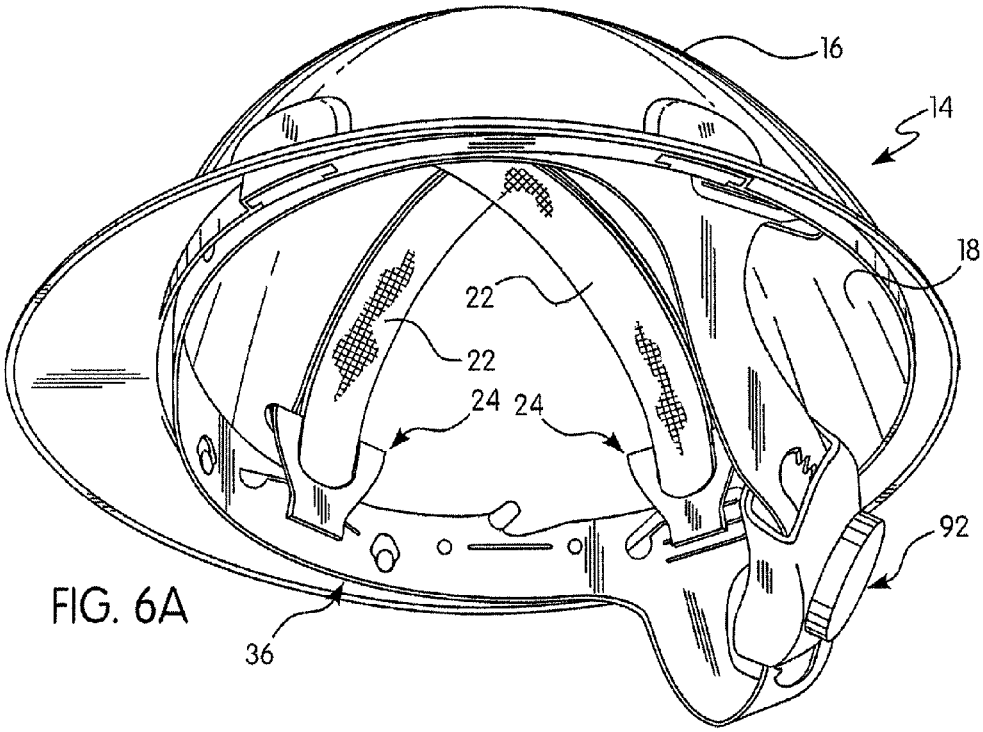
FIG. 6A is a perspective view of the fully assembled safety helmet, suspension system, and suspension connection arrangement according to FIG. 6 with the pad removed for clarity.
Figure 6:
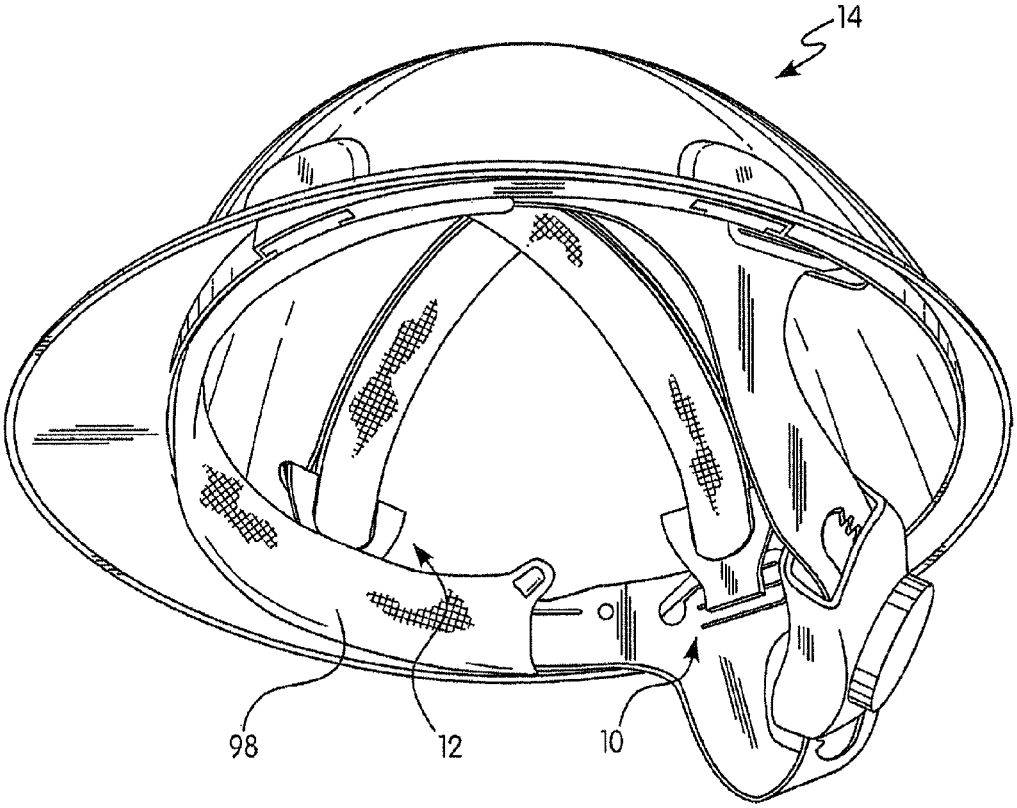
FIG. 6 is a perspective view of a fully assembled safety helmet, suspension system, and suspension connection arrangement according to FIG. 3.

In a further preferred and non-limiting embodiment, and as illustrated in FIGS. 3, 5, and 6, the headband arrangement 26 includes an adjustment mechanism 92 for tightening and loosening the headband member 36 with respect to the user's head. In particular, the adjustment mechanism 92 works in cooperation with extension portions 94 of the headband member 36, where each extension portion 94 includes a notched track 96. The adjustment mechanism 92 includes an appropriate gear-type or tooth member (not shown) for engaging with the tracks 96 on both extension portions 94. Therefore, in cooperation with the above-discussed upward and downward adjustment using the multiple keyhole 32/slot 34 arrangements in the set 88, the adjustment mechanism 92 allows for the further adjustment, i.e., tightening and loosening, of the headband member 36 with respect to the user's head. Still further, and with reference to FIGS. 3 and 6, the headband member 36 can be provided with a pad 98, such as a sweat pad or comfort pad, that contacts and rests against the user's forehead during use and operation.

In this manner, the present invention provides a suspension connection arrangement 10, a suspension system 12, and a safety helmet 14 that facilitates the adjustment and/or configuration of the headband arrangement 26 and/or headband member 36 with respect to the user's head. In addition, the suspension connection arrangement 10, suspension system 12, and safety helmet 14 according to the present invention allows for the efficient and effective assembly of the safety helmet 14 and its various components in the field.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A suspension connection arrangement for a suspension system of a safety helmet, the suspension system comprising at least one strap connected to at least one tab, which is attachable between a headband arrangement and at least one headband slot positioned on an internal surface of the safety helmet, the suspension connection arrangement comprising:

at least one projection member extending from the at least one tab; and at least one keyhole connected to at least one slot, both extending through a headband member, wherein the at least one keyhole is configured to at least partially receive the at least one projection member therethrough, such that the at least one projection member is configured to slide along the at least one slot, thereby removably attaching the at least one tab to the headband member, wherein at least a portion of the at least one keyhole and the at least one slot is positioned within a recessed area defined by a surrounding thickened area of the headband member, the recessed area bounded by a sidewall extending from an outer surface of the headband member in a thickness direction of the headband member for guiding the at least one projection member along at least one of the at least one keyhole and the at least one slot, wherein the thickened area at least partially surrounds the at least one keyhole and the at least one slot, and wherein at least a portion of the at least one projection member is positioned within the recessed area.

2. The suspension connection arrangement of claim 1, wherein the at least one projection member comprises a stem with a first end attached to a portion of the at least one tab and a cap positioned on a second end of the stem.

3. The suspension connection arrangement of claim 2, wherein the cap is substantially circular.

4. The suspension connection arrangement of claim 2, wherein the at least one keyhole is substantially semicircular, and the at least one slot extends from a lower portion of the at least one keyhole.

5. The suspension connection arrangement of claim 2, wherein the at least one keyhole is shaped to receive the at least one projection member through an angled urging force of the cap therethrough.

6. The suspension connection arrangement of claim 2, wherein the at least one keyhole and at least one slot are shaped such that a lower surface of the cap is configured to contact at least a portion of a headband member surface surrounding the at least one keyhole and at least one slot, thereby retaining the at least one projection member in the at least one keyhole and at least one slot.

7. The suspension connection arrangement of claim 1, wherein at least a portion of the at least one projection member is flexible for attachment within the at least one keyhole and at least one slot.

8. The suspension connection arrangement of claim 1, wherein at least a portion of the headband member is flexible.

9. The suspension connection arrangement of claim 1, wherein the at least one keyhole and the at least one slot is a plurality of keyholes and a respective plurality of slots.

10. The suspension connection arrangement of claim 9, further comprising a plurality of sets of the plurality of keyholes and respective slots positioned on the headband member.

11. A suspension connection arrangement for a suspension system of a safety helmet, the suspension system comprising at least one strap connected to a plurality of tabs, which is attachable between a headband arrangement and at least one headband slot positioned on an internal surface of the safety helmet, the suspension connection arrangement comprising:

at least one projection member extending from each of the plurality of tabs; and a plurality of arrangements each comprising a keyhole connected to a slot, both extending through a headband member, wherein the keyhole of each arrangement is configured to at least partially receive therethrough the at least one projection member of one of the plurality of tabs, such that the at least one projection member of each of the plurality of tabs is configured to slide along the at least one slot, thereby removably attaching each of the plurality of tabs to a specified area of the headband member;

wherein each of the plurality of arrangements is at least one of spaced and aligned on the headband member, wherein at least a portion of at least one of the keyhole and the slot of the plurality of arrangements is positioned within a recessed area defined by a surrounding thickened area of the headband member, the recessed area bounded by a sidewall extending from an outer surface of the headband member in a thickness direction of the headband member for guiding the at least one projection member along at least a portion of at least one of the plurality of arrangements, wherein the thickened area at least partially surrounds the at least one of the keyhole and the slot of the plurality of arrangements, and wherein at least a portion of the at least one projection member is positioned within the recessed area.

12. A suspension system for a safety helmet, comprising:

a headband arrangement having a headband member;

at least one strap connected to at least one tab, wherein the at least one tab is configured to be inserted at least partially into at least one headband slot positioned on an internal surface of the safety helmet; and a suspension connection arrangement, comprising:

(i) at least one projection member extending from the at least one tab; and (ii) at least one keyhole connected to at least one slot, both extending through the headband member, wherein the at least one keyhole is configured to at least partially receive the at least one projection member therethrough, such that the at least one projection member is configured to slide along the at least one slot, thereby removably attaching the at least one tab to the headband member, wherein at least a portion of the at least one keyhole and the at least one slot is positioned within a recessed area defined by a surrounding thickened area of the headband member, the recessed area bounded by a sidewall extending from an outer surface of the headband member in a thickness direction of the headband member for guiding the at least one projection member along at least one of the at least one keyhole and the at least one slot, wherein the thickened area at least partially surrounds the at least one keyhole and the at least one slot, and wherein at least a portion of the at least one projection member is positioned within the recessed area.

13. The suspension system of claim 12, wherein the headband arrangement further comprises an adjustment mechanism for tightening and loosening the headband member with respect to a user's head.

14. The suspension system of claim 12, wherein the headband arrangement further comprises at least one pad configured to contact a user's head.

15. The suspension system of claim 12, wherein the at least one projection member of the suspension connection arrangement comprises a stem with a first end attached to a portion of the at least one tab and a cap positioned on the second end of the stem.

16. A safety helmet, comprising:

a protective helmet body having an internal surface with at least one headband slot positioned thereon;

a suspension system, comprising:

(i) a headband arrangement having a headband member; and (ii) at least one strap connected to at least one tab, wherein the at least one tab is configured to be inserted at least partially into the at least one headband slot to thereby connect the suspension system and the protective helmet body; and a suspension connection arrangement, comprising:

(i) at least one projection member extending from the at least one tab; and (ii) at least one keyhole connected to at least one slot, both extending through the headband member, wherein the at least one keyhole is configured to at least partially receive the at least one projection member therethrough, such that the at least one projection member is configured to slide along the at least one slot, thereby removably attaching the at least one tab to the headband member, wherein at least a portion of the at least one keyhole and the at least one slot is positioned within a recessed area defined within a surrounding thickened area of the headband member, the recessed area bounded by a sidewall extending from an outer surface of the headband member in a thickness direction of the headband member for guiding the at least one projection member along at least one of the at least one keyhole and the at least one slot, wherein the thickened area at least partially surrounds the at least one keyhole and the at least one slot, and wherein at least a portion of the at least one projection member is positioned within the recessed area.

17. The safety helmet of claim 16, wherein the headband arrangement further comprises an adjustment mechanism for tightening and loosening the headband member with respect to a user's head.

18. The safety helmet of claim 16, wherein the headband arrangement further comprises at least one pad configured to contact a user's head.

* * * * *